US006105384A

United States Patent [19]

Joseph

[11] Patent Number: 6,105,384

[45] Date of Patent: Aug. 22, 2000

[54] SELF-COOLING OR SELF-HEATING FOOD OR BEVERAGE CONTAINER HAVING HEAT EXCHANGE UNIT WITH EXTERNAL PROTECTIVE COATING

[75] Inventor: Mitchell J. Joseph, Laguna Hills, Calif.

[73] Assignee: Chill-Can International, Inc., Laguna Niguel, Calif.

[21] Appl. No.: 09/229,690

[22] Filed: Jan. 19, 1999

[51] Int. Cl.[7] ..... F25D 3/08

[52] U.S. Cl. ..... 62/293; 165/133; 426/398

[58] Field of Search ..... 165/133; 426/109, 426/131, 398; 427/154; 62/293, 371

[56] References Cited

U.S. PATENT DOCUMENTS 4,615,924 10/1986 Hekal et al. ..... 428/35
5,199,486 4/1993 Balmer et al. ..... 165/133
5,331,817 7/1994 Anthony ..... 62/293
5,692,381 12/1997 Garrett ..... 62/60

OTHER PUBLICATIONS

Food Canning Technology, 1997, pp. 300–301, Wiley–VCH, inc.

*Primary Examiner*—William E. Tapolcai
*Attorney, Agent, or Firm*—Fulbright & Jaworski L.L.P.

[57] ABSTRACT

A heat exchange unit for incorporation internally of a food or beverage container in such a manner that the external surface thereof is in contact with the food or beverage. A food grade coating is adhered to and completely covers the entire exterior surface of the heat exchange unit to preclude direct contact of the food or beverage with surface of the heat exchange unit.

11 Claims, 3 Drawing Sheets

FIG. 3
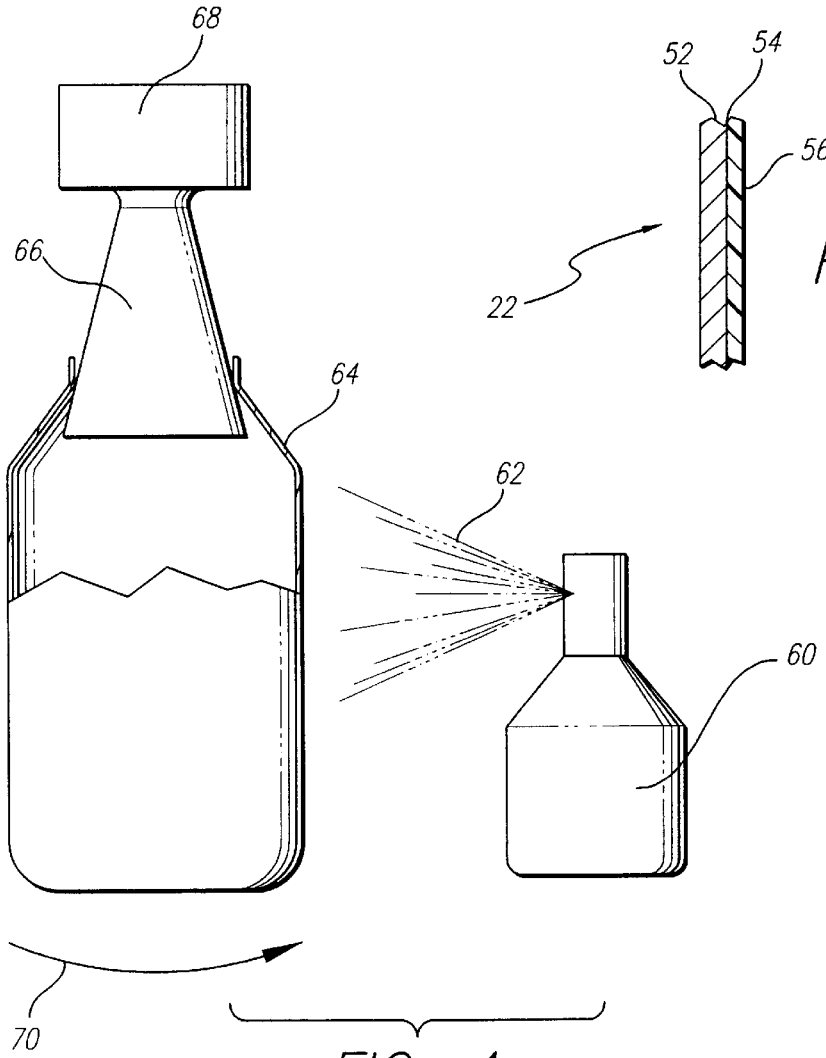
FIG. 4
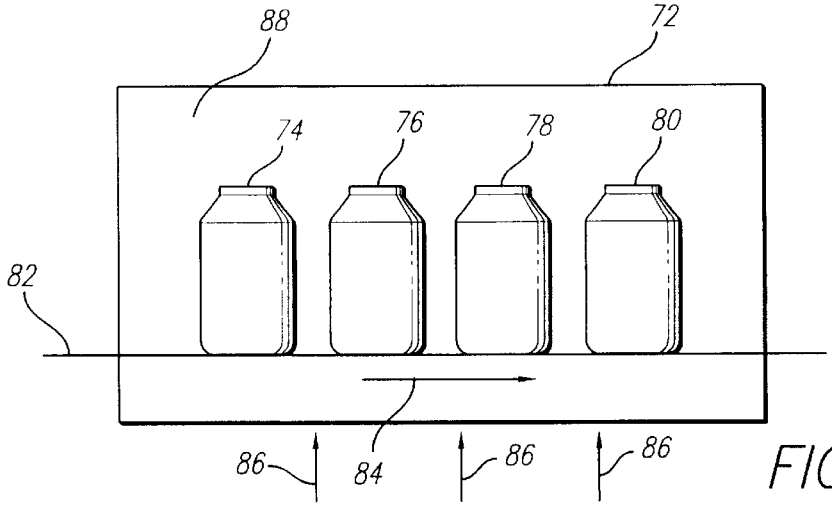
FIG. 5

SELF-COOLING OR SELF-HEATING FOOD OR BEVERAGE CONTAINER HAVING HEAT EXCHANGE UNIT WITH EXTERNAL PROTECTIVE COATING

BACKGROUND OF THE INVENTION

The present invention relates generally to temperature changing devices and more specifically to containers for cooling or heating a product such as a food or beverage through the use of a heat exchange unit secured within the container. More specifically, the present invention relates to such a container wherein the heat exchange unit is secured within the container and the heat exchange unit has an external protective coating on its outer surface.

DESCRIPTION OF THE PRIOR ART

It has long been desirable to provide a simple, effective and safe device which may be housed within a container such as a food or beverage container for the purpose of cooling or heating a product such as a food or beverage on demand. With respect to self-cooling containers, various types of devices have been developed to accomplish such desired self-cooling and various types of refrigerants have been disclosed for accomplishing such cooling. The refrigerant devices may be chemical, electrical, include gaseous reactions and the like. Typical of such devices known to applicant are those disclosed in U.S. Pat. Nos. 2,460,765; 3,373,581; 3,636,726; 3,726,106; 4,584,848; 4,656,838; 4,784,678; 5,214,933; 5,285,812; 5,325,680; 5,331,817; 5,606,866; 5,692,381 and 5,692,391. In each of the devices disclosed in the prior art a heat exchange unit is positioned within a beverage container and includes a refrigerant means of some type to cool the beverage coming into contact with the heat exchange unit outer surface. However, none of the foregoing devices address the issue of possible contamination of the food or beverage or degradation of the taste thereof as a result of its coming into contact with the outer surface of the heat exchange unit and many and if not all instances the heat exchange unit includes a metallic substance to provide effective and efficient heat transfer from the beverage to the refrigerant medium contained within the heat exchange unit to accomplish the desired self-cooling. Certain metallic substances such as aluminum, steel and the like may, depending upon their constituency, contain substances which can over a long term period of time be deleterious to human health.

With respect to self-heating containers there are known prior art devices which may be used to accomplish each. One such device is illustrated and described in U.S. Pat. No. 5,626,022. As is therein shown, a heat exchange unit is supported internally of the container and when activated provides an exothermic reaction to heat the contents of the container which contacts the external surface of the HEU. The HEU body is made of metal such as aluminum, and encounters the same problems with respect to contamination and taste as does and HEU in a self-cooling device.

SUMMARY OF THE INVENTION

The foregoing difficulties of the prior art products are addressed by the present invention which provides a food or beverage container including a heat exchange unit mounted therein for heating or cooling a product contained within the container. The heat exchange unit includes an outer surface which is in contact with the food or beverage. A food grade epoxy enamel coating covers the outer surface of the heat exchange unit to preclude the food or beverage from contacting any non-food grade material.

BRIEF DESCRIPTION OF THE DRAWINGS

FIG. 3 is a partial cross-sectional schematic representation of a portion of the wall of the heat exchange unit of the structure as shown in FIG. 1;

FIG. 4 is a schematic illustration showing the manner in which the outer surface of the heat exchange unit is coated; and FIG. 5 illustrates the manner in which the coating on the outer surface of the heat exchange unit is cured.

DETAILED DESCRIPTION OF THE INVENTION

Figure 1:
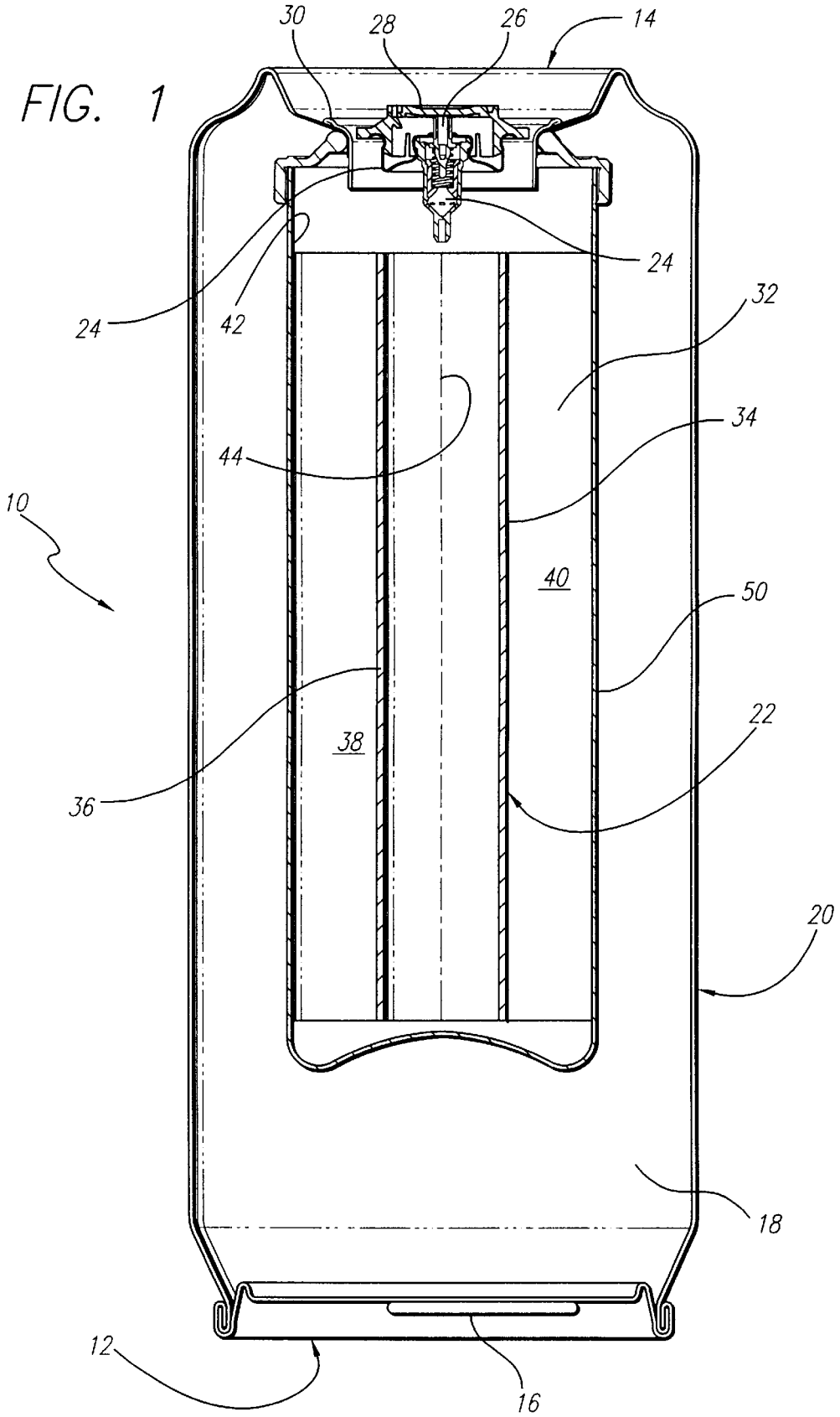
FIG. 1 is a schematic diagram partly in cross section illustrating a self-cooling beverage container constructed in accordance with the principles of the present invention.

Referring now to the drawings and more particularly to FIG. 1. There is shown a beverage container system 10 constructed in accordance with the principles of the present invention. As above indicated, the present invention is equally applicable to self-heating or self-cooling containers for food or beverage. However, for purposes of clarity and ease of description only a self-cooling beverage container system will be illustrated and described. The beverage container system 10 includes a top 12 and a bottom 14. Secured to the top 12 is a typical opening structure such as a pulltab 16. A product preferably such as a beverage 18 is contained within the beverage can 20. A heat exchange unit (HEU) 22 is secured as by crimping to the bottom 14 of the beverage can 20. A valve mechanism 24 is secured to the heat exchange unit 22 and contains a valve 24 which when actuated releases or activates a refrigerant contained within the HEU 22 allowing it to escape carrying with it heat which has been transferred from the beverage 18 to the refrigerant. If the contents of the container 20 was food or the HEU contained an exothermic product, a similar reaction would occur. The valve mechanism 24 is activated by a plunger 26 which is protected by an overcap 28. The overcap protects the plunger 26 from inadvertent activation and also provides an indicator to the purchasing consumer that the heat exchange unit has not been previously activated. The overcap 28 is secured in place by an appropriate downwardly depending skirt and flange 30 which is secured to the valve mechanism 24.

The heat exchange unit 22 may contain a refrigerant medium which is any known to the art and which functions to conduct the heat contained within the beverage 18 out of the beverage and into the atmosphere as the refrigerant escapes once the heat exchange unit has been activated by depressing the plunger 26. Various types of refrigerants have been disclosed in the prior art patents above referred to. However, the preferred refrigerant medium for the present invention is an adsorbent/desorbent mechanism preferably utilizing materials such as zeolites, cation exchange zeolites, silica gel, activated carbons and carbon molecular sieves and the like as the adsorbent. These adsorbents are capable of adsorbing under pressure a significant quantity of gas for later release. The gas adsorbed therein can be any suitable gas that is inert and is friendly to the atmosphere. Preferably the gas in accordance with the present invention comprises carbon dioxide.

The carbon dioxide adsorbed in the adsorbent, preferably activated carbon particles, when released to atmospheric pressure will experience a significant drop in temperature thereby chilling the contents of the beverage 18 which comes into contact with the outer surface of the heat exchange unit 22. A more detailed explanation of the carbon-carbon dioxide adsorbent refrigeration system is contained in U.S. Pat. No. 5,692,381 above referred to and incorporated herein by reference. Therefore a further and more detailed explanation of the carbon-carbon dioxide refrigerant system will not be provided herein.

In order to provide a more efficient transfer of heat from the beverage 18 to the carbon dioxide gas as it desorbs from the carbon particles, a heat transfer mechanism 32 may be inserted into the interior of the heat exchange unit 22. Preferably the heat transfer mechanism is in the form of a heat sink containing fins such as shown at 34 through 40 which intimately contact the interior surface 42 of the heat exchange unit 22 and converge at a centralized point 44 within the interior of the heat exchange unit.

Figure 2:
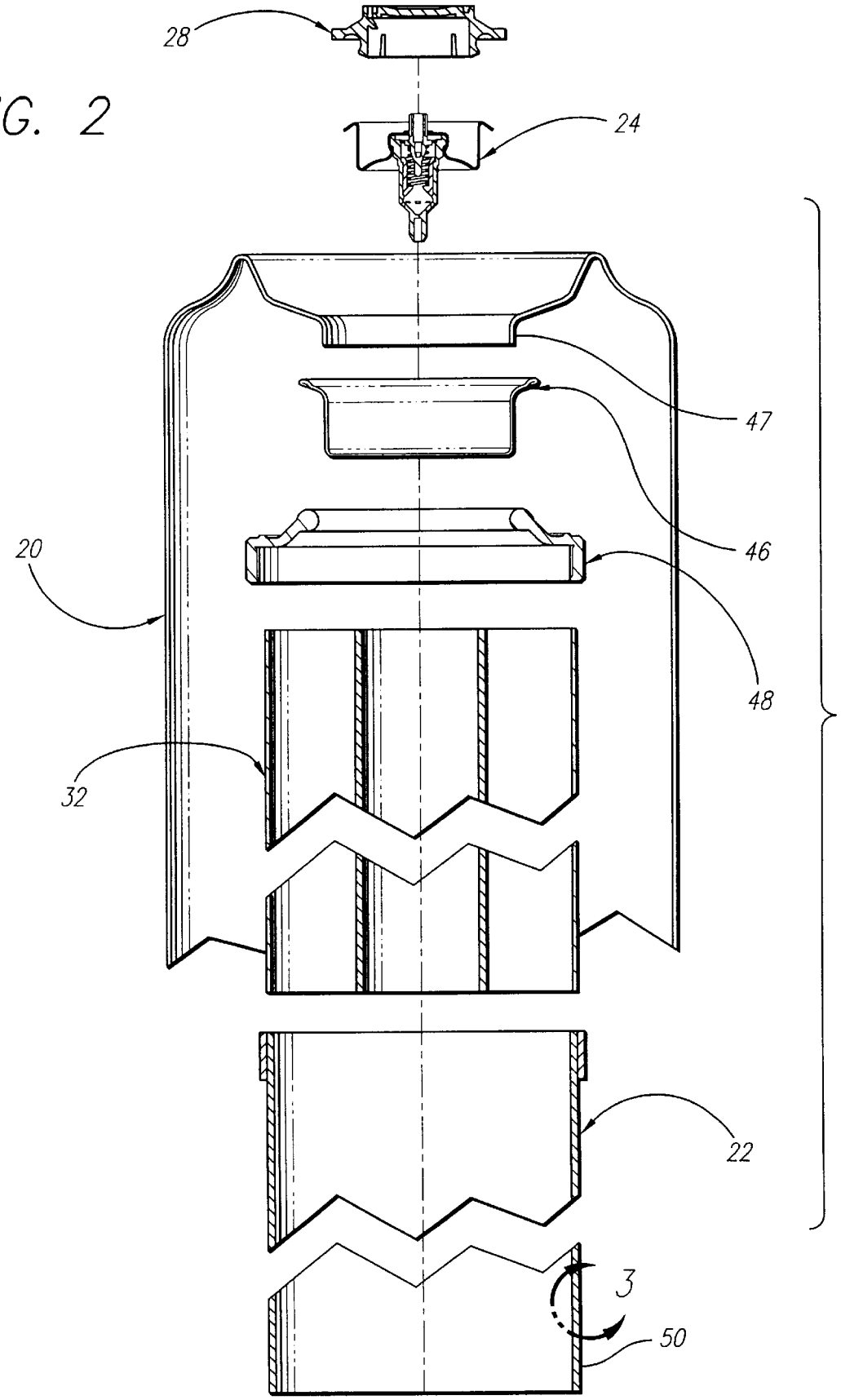
FIG. 2 is an exploded view of the self-cooling beverage container disclosed in FIG. 1.

By reference to FIG. 2 a more thorough understanding of the structure as illustrated in FIG. 1 can be obtained. The structure of FIG. 1 is shown in exploded form in FIG. 2 and the parts above described with regard to FIG. 1 are illustrated utilizing the same reference numerals in FIG. 2. In addition, there is shown a sealing gasket 46 which is interposed between a flange 47 formed in the bottom 14 of the can and the top or cap 48 of the heat exchange unit 22 during the assembly process whereby the heat exchange unit is crimped in place to the bottom 14 of the beverage container 20 as is more specifically shown in FIG. 1. The sealing gasket 46 precludes any loss of contents of the beverage 18 from the container 20 by providing a more effective seal between the beverage can 20 and the heat exchange unit 22. The heat exchange unit of FIG. 2 is shown as a two piece device instead of one piece as shown in FIG. 1. Either structure is acceptable and may be used depending upon the particular application.

As above discussed, the heat exchange unit 22 includes an outer surface 50 which comes into contact with the beverage 18 (or food) which is contained within the beverage can 20. Typically the heat exchange unit is manufactured from a metallic material such as aluminum, steel or the like so that effective and efficient heat transfer of the heat from the beverage 18 to the desorbed carbon dioxide refrigerant gas can be accomplished to thereby rapidly decrease the temperature of the beverage 18 for consumption. In some instances, metallic materials such as aluminum, steel and the like may contain contaminants therein which over the long term have proven to be deleterious to human health. Also in some instances, such materials may alter the taste of the food or beverage. It is therefore, a necessity that the outer surface 50 of the heat exchange unit be treated in such a manner as to neutralize any foreign contamination or preclude a taste change which could occur as a result of the beverage 18 coming into contact with the outer surface 50 of the heat exchange unit.

By reference now to FIG. 3 a partial cross section of the wall of the heat exchange unit 22 with the outer surface 50 containing a coating is shown. FIG. 3 is taken about the circle 3 as shown in FIG. 2.

As is shown in FIG. 3 the wall 52 of the heat exchange unit 22 contains an outer surface 54 upon which a coating 56 has been placed. The coating 56 must be tenaciously secured to the surface 54 of the wall 52 in such a manner that it can withstand the handling which is required to place the adsorbent material, the heat sink and the valve mechanism into the HEU and to crimp and thereby secure the entire HEU to the bottom of the can as shown in FIG. 1. Therefore, it will be recognized that the coating 56 must be bonded extremely securely to the outer surface 54 and must be extremely tough to withstand the handling that is required. At the same time the coating 56 must be such that it will not inhibit the transfer of heat from the beverage 18 into the desorbing carbon dioxide during the chilling process or the transfer of heat from the HEU to the food or beverage in the container.

Preferably the coating 56 is an epoxy enamel coating which is of a food grade quality and which is evenly coated over the entire exterior surface 54 of the heat exchange unit 22 so that any portion of the surface 54 which could come into contact with the beverage 18 in the self-cooling beverage container system 10 is completely covered by the coating 56. It has been found that the coating should be of thickness between 4 and 10 microns and is preferably between 4.9 and 5.2 microns per square inch. The coating preferably is a water based epoxy spray enamel which is dissolved in a solvent system comprising water, glycolether and alcohol having a viscosity such that the coating can be easily and readily applied to the outer surface 24 of the heat exchange unit 22. Such a coating has been found to be equally effective for systems wherein heat is transferred from the HEU to the food or beverage.

One method for applying the coating 56 to the outer surface 54 of the heat exchange unit 22 is by airless spraying which is illustrated in FIG. 4 to which reference is hereby made. As is schematically illustrated therein a spraying unit 60 which can be activated by a wall known airless spraying techniques such as by electrical energy is illustrated. When activated, a spray 62 emanates therefrom in extremely fine particles which will attach to surfaces readily when they are contacted by the spray. As is illustrated, a heat exchange unit 64 may be held by a mechanism 66 which is attached to a rotor 68 which will rotate the heat exchange unit 64 as illustrated by the arrow 70. As the heat exchange unit 64 is rotated the spray contacts the entire outer surface of the heat exchange unit 64 and adheres readily thereto. The epoxy and the enamel are thoroughly inter mixed and bonded together. When this mixture contacts the outer surface of the HEU, the epoxy bonds to that surface and in turn, bonds the enamel to the HEU surface. Although spraying is the preferred manner in which the coating 56 is applied to the heat exchange unit it should also be understood by those skilled in the art that other application techniques such as rolling, dipping, painting and the like may also be utilized. The only criteria which must be adhered to is that the coating 64 must be evenly and throughly applied to cover the entire outer surface of the heat exchange unit so that no uncoated surfaces are permitted to come into contact with the beverage 18 (or food) contained in the container.

As above indicated, the epoxy food grade enamel is dissolved in glycolether and alcohol. These substances must be removed to render the outer surface of the heat exchange unit food grade insofar as the coating is concerned. This is accomplished by the application of heat as is illustrated in FIG. 5. As is therein shown an oven or the like 72 is provided within which there is disposed a number of coated heat exchange units as illustrated at 74 through 80. These units may be resting on or suspended from a belt 82 or the like which moves continuously through the oven 72 as illustrated by the arrow 84. The oven 72 has heat applied thereto as shown by the arrows 86 to elevate the temperature contained within the interior 88 of the oven to approximately 400° Fahrenheit. The transit time of the heat exchange units 74 through 80 within the interior 88 of the oven 72 is approximately 2 minutes which at the elevated temperature of approximately 400° will adequately drive off all of the undesirable solvents and cure the coating 56 so that it becomes tenaciously affixed to the outer surface 54 of the heat exchange unit 22. Obviously other techniques may also be utilized for curing the coating so that it is appropriately tenaciously attached to the outer surface of the heat exchange unit 52 without departing from the principles or spirit of the present invention.

Although the present invention is described with reference to the heat exchange unit being a preformed cannister like member, it should be understood that the protective food grade coating may be applied to the surface of a metal sheet which is then appropriately cut and formed into the desired shape for the heat exchange unit.

What is claimed is:

1. A food or beverage container comprising:

a first vessel for containing food or beverage;

a heat exchange unit including a second vessel disposed within said first vessel and having an outer surface for contacting said food or beverage; and a food grade coating covering said outer surface.

2. A food or beverage container as defined in claim 1, wherein said second vessel is made of steel.

3. A food or beverage container as defined in claim 1, wherein said second vessel is made of aluminum.

4. A food or beverage container as defined in claim 1, wherein said coating has a thickness of approximately 4 to 10 microns per square inch.

5. A food or beverage container as defined in claim 1, wherein said second vessel is secured within said first vessel by crimping.

6. A food or beverage container as defined in claim 5, wherein said first vessel includes a top and a bottom and said second vessel is crimped to the bottom of said first vessel.

7. A food or beverage container as defined in claim 6, wherein said second vessel contains a refrigerant.

8. A food or beverage container as defined in claim 7, wherein said refrigerant includes carbon dioxide absorbed onto carbon.

9. A food or beverage container as defined in claim 1, wherein said coating is a food grade enamel coating.

10. A food or beverage container as defined in claim 9, wherein said coating comprises epoxy.

11. A food or beverage container as defined in claim 10, wherein said, coating has been temperature cured in place on said outer surface.

* * * * *